US005617816A

United States Patent [19]

Saur et al.

[11] Patent Number: 5,617,816

[45] Date of Patent: Apr. 8, 1997

[54] COOLING SYSTEM FOR AN INTERNAL-COMBUSTION ENGINE OF A MOTOR VEHICLE HAVING A THERMOSTATIC VALVE

[75] Inventors: Roland Saur, Stuttgart; Peter Leu, Denkendorf, both of Germany

[73] Assignee: Behr-Thomson-Dehnstoffregler GmbH & Co., Germany

[21] Appl. No.: 584,399

[22] Filed: Jan. 11, 1996

[30] Foreign Application Priority Data

Jan. 12, 1995 [DE] Germany ..... 195 00 648.8

[51] Int. Cl.[6] ..... F01P 5/02

[52] U.S. Cl. ..... 123/41.08; 123/41.12

[58] Field of Search ..... 123/41.08, 41.12, 123/41.02, 41.09

[56] References Cited

U.S. PATENT DOCUMENTS

| | | | |
|---|---|---|---|
| 4,062,329 | 12/1977 | Rio | 123/41.12 |
| 4,168,456 | 9/1979 | Isobe | 123/41.12 |
| 4,378,760 | 4/1983 | Barge | 123/41.12 |
| 4,537,158 | 8/1985 | Saur | 123/41.1 |
| 4,546,742 | 10/1985 | Sturges | 123/41.12 |
| 4,557,223 | 12/1985 | N Gueyen | 123/41.12 |
| 4,691,668 | 9/1987 | West | 123/41.12 |
| 4,765,284 | 8/1988 | Kanazawa et al. | 123/41.12 |
| 4,955,431 | 9/1990 | Saur et al. | 123/41.12 |
| 5,018,484 | 5/1991 | Naitoh | 123/41.12 |
| 5,307,644 | 5/1994 | Cummins et al. | 123/41.12 |
| 5,477,827 | 12/1995 | Weisman, II et al. | 123/436 |
| 5,483,927 | 1/1996 | Letang et al. | 123/41.12 |

FOREIGN PATENT DOCUMENTS

| | | |
|---|---|---|
| 128365 | 12/1984 | European Pat. Off. . |
| 4015806 | 11/1990 | Germany . |
| 4409547 | 1/1995 | Germany . |
| 2280258 | 1/1995 | United Kingdom . |

*Primary Examiner*—David A. Okonsky

*Attorney, Agent, or Firm*—Evenson, McKeown, Edwards & Lenahan P.L.L.C.

[57] ABSTRACT

A cooling system and a method for controlling a cooling system for an internal-combustion engine of a motor vehicle having a thermostatic valve which can be switched over from a higher control level to a lower control level. A fan is provided which is assigned to a coolant radiator and which contains a fan control circuit with a temperature comparison step which compares the ACTUAL temperature of the coolant with a desired value. When the desired value is exceeded, a temperature signal is generated which is applied to an input of an AND-element. A switching signal for the switch-over of the thermostatic valve to the lower control level is applied to the other input of the AND-element which forms a switch-on signal for the fan.

20 Claims, 1 Drawing Sheet

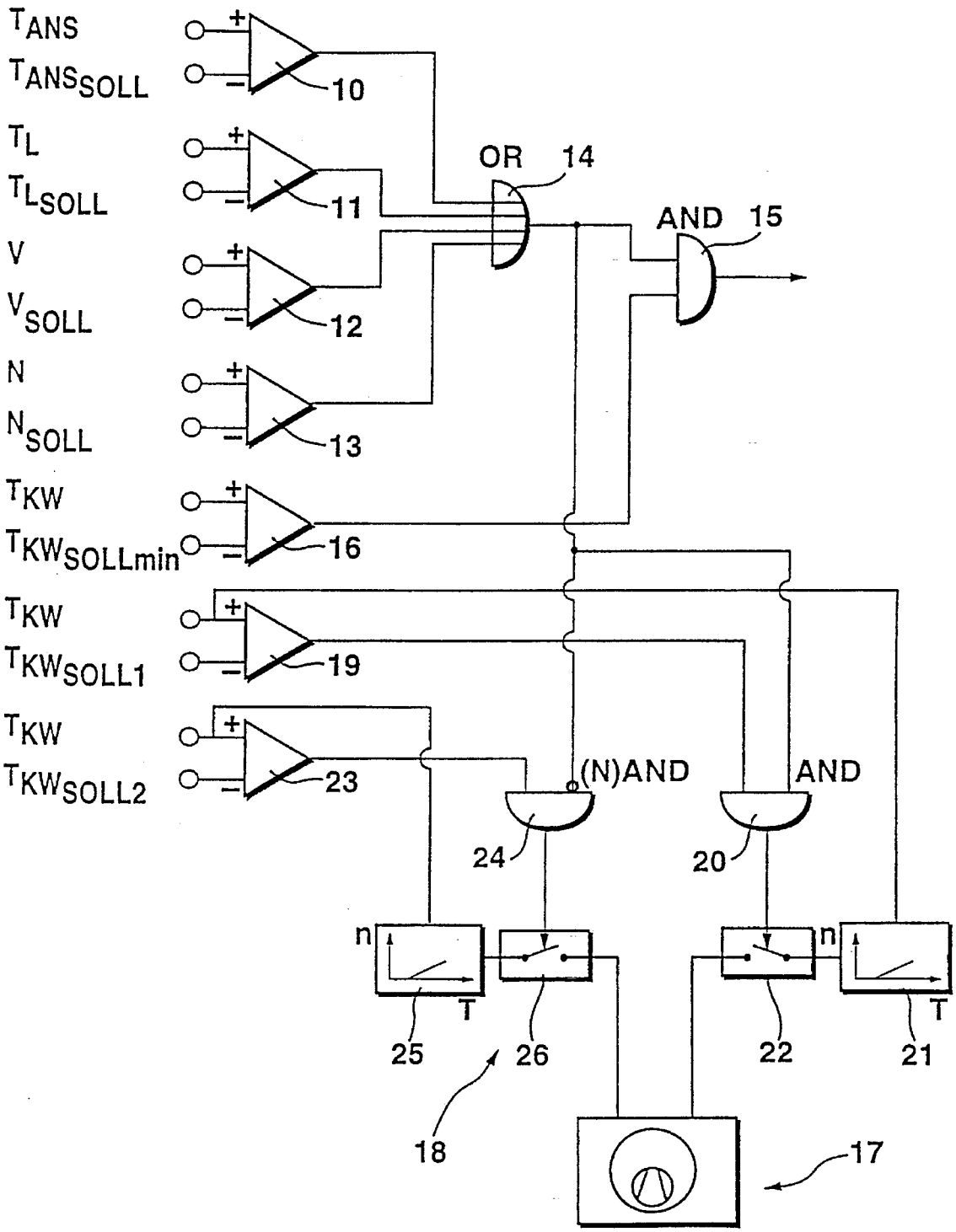
TANS
TANSSOLL
TL
TLSOLL
V
VSOLL
N
NSOLL
TKW
TKWSOLLmin
TKW
TKWSOLL1
TKW
TKWSOLL2
10
11
12
13
16
19
23
OR
14
AND
15
(N)AND
AND
24
20
n
T
25
26
22
21
18
17

COOLING SYSTEM FOR AN INTERNAL-COMBUSTION ENGINE OF A MOTOR VEHICLE HAVING A THERMOSTATIC VALVE

BACKGROUND AND SUMMARY OF THE INVENTION

This invention relates to a cooling system and a method for controlling a cooling system for an internal-combustion engine of a motor vehicle having a thermostatic valve which controls the quantity of coolant which flows through a short-circuit pipe and/or a coolant radiator from an engine outlet to an engine inlet, and which thermostatic valve can be switched by means of switching signals depending on operating parameters of the internal-combustion engine and/or environmental parameters from a higher control level of the coolant temperature to a lower control level of the coolant temperature, and having a fan which is assigned to the coolant radiator and can be switched by means of a fan control circuit.

A cooling system of the type generally described above is an object of German Patent Application DE 44 09 547.3 which is not a prior publication. In the case of this cooling system, a requirement-oriented cooling takes place, during which the cooling system is normally operated at a higher control level of the coolant temperature. In cases in which an increased demand for cooling output is expected and necessary, a switch-over of the thermostatic valve takes place to the lower control level of the coolant temperature. The fan, which in the case of this construction is assigned to the coolant radiator, is switched on by a fan control circuit when a switch-over takes place from the higher control level of the thermostatic valve to the lower control level. In this case, the switch-on duration of the fan is limited by a time function element.

A cooling system for an internal-combustion engine with a switchable thermostatic valve is also known (European Patent Document EP-B 0 128 365) which contains a separate fan operating control circuit for a fan assigned to a coolant radiator. The fan is operated as a function of the coolant temperature sensed by a temperature sensor with different output steps; that is, in the case of a lower coolant temperature, with a lower output and, in the case of a higher coolant temperature, with a higher output. When the thermostatic valve is switched over to a higher opening temperature, the switching-on of the fan is blocked at lower coolant temperatures in order not to counteract the reaching of the higher opening temperature.

It is an object of the invention to control, in the case of the cooling system of the initially mentioned type, the fan in such a manner that it is operated corresponding to the adjustment to the higher and the lower control level and promotes the reaching of the endeavored coolant temperature and of the respective demanded cooling output.

This object is achieved by providing a fan control circuit that contains a temperature comparison step which compares the ACTUAL temperature of the coolant with a desired value and, when the desired value is exceeded, generates a temperature signal which is applied to an input of an AND-element to whose other input the switching signal of the thermostatic valve is applied and which generates a switch-on signal for the fan.

In the case of this construction, the fan will only be switched on when the switching signal is present by means of which the thermostatic valve is switched back to the lower control level, and the given desired value is exceeded. Thus, the switching-on of the fan does not hinder the thermostatic valve from reaching the higher control level. Likewise, after the switch-over to the lower control level, this control level is reached faster because then the fan participates in the demanded, increased cooling output.

In one advantageous embodiment of the invention, the desired value for the temperature comparison step is in the range of the low control level of the thermostatic valve. Therefore, the fan participates in the cooling performance also in this control range in which an increased cooling output is required. In this case, the desired value advantageously corresponds approximately to the opening temperature of the thermostatic value adjusted to the lower control level. As a result, in the case of this setting of the thermostatic valve, the fan participates in the application and the control of the cooling output.

In another embodiment of the invention, the fan control contains a control step which determines the fan output as a function of the ACTUAL temperature of the coolant. Thus, the fan also acquires a control behavior by means of which it participates in the control of the coolant temperature. In an advantageous development, the control step contains a characteristic diagram in which coolant temperatures and assigned fan outputs are filed. This permits the control step to be adapted to the construction of the internal-combustion engine and/or the cooling system by means of a suitable characteristic diagram.

In a further development of the invention, the fan control circuit contains another temperature comparison step which compares the ACTUAL temperature of the coolant with a desired value and generates a temperature signal which represents an exceeding of the desired value and which is applied to a non-negated input of an (N)AND-element This (N)AND-element is an AND-element with one negated input and one non-negated input. The switching signal for the thermostatic value is applied to the negated input of the (N)AND element. The output of the (N)AND element generates another switch-on signal for the fan. By means of this embodiment, the fan is also switched on when an increased cooling output is required when a desired temperature level is reached, without any switch-over of the thermostatic valve to the lower control range. Since the fan participates in the cooling during the operation at the higher control level, advantages are obtained in the lay-out of the size of the coolant radiator.

In a further development of the invention, the desired value for the additional temperature comparison step is in the range of the higher control level of the thermostatic valve. It is advantageous for the desired value to correspond to the coolant temperature at which the thermostatic value has reached approximately 75% of its opening stroke.

In a further development of the invention, the fan control contains another control step which can be activated by the switch-on signal of the additional temperature step and which determines the fan output as a function of the ACTUAL temperature of the coolant. Also in the case of this further development, it is advantageous for the additional control step to contain a characteristic diagram in which coolant temperatures and assigned fan outputs are filed. It will then also be possible to adapt the control step to the construction of the internal-combustion engine and/or of the whole cooling system by determining a corresponding characteristic diagram.

In its basic construction, the cooling system may correspond to the cooling system illustrated and explained in German Patent Application DE 44 09 547.3. It contains a thermostatic valve which is equipped with a thermostatic working element. The thermostatic working element contains an expansion medium, particularly a wax mixture, which, in a predetermined temperature range, experiences a considerable change of volume and, in the process, moves out a working piston which opens up the thermostatic valve. The thermostatic valve controls the quantities of coolant which flow from an engine outlet of the internal-combustion engine through a coolant radiator and/or through a short-circuit pipe to the engine inlet of the internal-combustion engine. The lay-out of the expansion medium (wax mixture) determines the opening temperature of the thermostatic valve at which a flow through the coolant radiator starts and thus a control of the cooling, When the opening temperature is exceeded, the thermostatic valve carries out an opening stroke at which finally the flow cross-section for the coolant quantity flowing through the coolant radiator is opened up completely and the flow cross-section of the short-circuit pipe is closed completely.

The expansion medium is laid out in such a manner that the opening temperature is relatively high, for example, at 105° C., while the full opening stroke is reached at approximately 120°. As a result, an increased control level is obtained at which the coolant temperature is controlled to, for example, 115° C.

When a higher cooling performance is required, as a function of operating parameters of the internal-combustion engine and/or environmental parameters, the thermostatic valve can be switched to a lower control level. For this purpose, the thermostatic working element is provided with an electric heating device by which the expansion medium can be heated to a temperature which is above the coolant temperature. As a result, the thermostatic valve opens up further so that a larger quantity of coolant flows through the radiator. Because of the increased cooling, the coolant temperature will then be lowered. As a result, the thermostatic valve will then operate at a lower control level or control range; that is, it opens at a coolant temperature of as low as 80° C. so that then a coolant temperature of, for example, 85° C. is set.

These and other objects, features and advantages of the present invention will become more readily apparent from the following detailed description when taken in conjunction with the accompanying drawings.

BRIEF DESCRIPTION OF THE DRAWING

The drawing illustrates a fan control circuit for a cooling system according to a preferred embodiment of the invention in the form of a logic diagram.

DETAILED DESCRIPTION OF THE DRAWING

The drawing illustrates several parameters from which a signal is generated on the basis of which the thermostatic valve is switched over from the higher control level to the lower control level in order to increase the cooling output. This signal is generated, for example, by means of comparison steps 10, 11, 12, 13 which are connected to the inputs of an OR-element 14. The comparison step 10 compares the temperature ($T_{ANS}$) in the intake pipe with a desired value ($T_{ANS\ Soll}$); the comparison step 11 compares a load signal ($T_L$) with a desired value ($T_{L\ Soll}$); the comparison step 12 compares the vehicle speed (V) with a desired value ($V_{Soll}$); and the comparison step 13 compares the rotational engine speed (N) with a desired value ($N_{Soll}$). When the ACTUAL values exceed the desired values, the OR-element 14 transmits each of the arriving signals to the input of an AND-element 15 which generates the actual signal which activates the heating element of the thermostatic working element. Since it only makes sense to activate the heating element of the thermostatic working element above a minimum temperature, a minimum temperature comparison step 16 is connected to the AND-element 15, which minimum temperature comparison step 16 compares the coolant temperature ($T_{KW}$) with a desired minimum value ($T_{KW\ Soll\ min}$) and emits a signal only when the minimum temperature is exceeded. The heating device of the thermostatic working element is switched on only when the minimum temperature ($T_{KW\ Soll\ min}$) is exceeded, and at least one of the comparison steps 10, 11, 12 and 13 generates a signal.

A fan 17 is assigned to the coolant radiator which is not shown, which fan can be switched by means of a fan control circuit 18 in such a manner that, on the one hand, it contributes to the required cooling output but, on the other hand, does not hinder the reaching of the higher coolant temperature and thus of the higher control level and, in addition, promotes a switch-over to the lower coolant temperature and thus the lower control level. The fan control circuit contains a first temperature comparison step 19 which compares the ACTUAL temperature ($T_{KW}$) of the coolant with a first desired value ($T_{KW\ Soll\ 1}$) of the coolant and, when this first desired value is exceeded, supplies a temperature signal to the input of an AND-element 20. The second input of this AND-element 20 is connected to the output of the OR-element 14. The AND-element 20 therefore only generates an output signal if one of the comparison steps 10 to 13 emits a signal which calls for a switch-over of the thermostatic valve to the lower control level. The signal of the AND-element 20 is evaluated as a switch-on signal for the fan 17 so that the fan 17 will be switched on by way of this part of the fan control circuit 18 only when a signal from the OR-element 14 is present for the switch-over of the thermostatic valve to the lower control level and the ACTUAL temperature ($T_{KW}$) of the coolant has exceeded first the desired value ($T_{KW\ Soll\ 1}$).

A control step 21 is assigned to the fan 17 and contains a characteristic diagram in which fan outputs are filed which are assigned to coolant temperatures, for example, in the form of assigned rotational fan speeds. The signal of the ACTUAL temperature ($T_{KW}$) of the coolant is applied to this control step so that the control step 21 then assigns a signal to this temperature which corresponds to a rotational fan speed and thus to a fan output. This output signal is transmitted to the fan 17 by means of a switch 22. This output signal will be transmitted to the fan 17 by means of the switch 22 only if the switch 22 is closed because of the signal of the AND-element 20; that is, only if a signal is present for the switch-over of the thermostatic valve to the lower control level and simultaneously the ACTUAL temperature ($T_{KW}$) of the coolant has exceeded the desired value ($T_{KW\ Soll\ 1}$). The fan 17 therefore participates in the overall cooling performance, that is, the fast reaching of the lower control level, and in the cooling performance required during the maintaining of the lower control level. The desired value ($T_{KW\ Soll\ 1}$) of the coolant temperature is therefore set at a value which corresponds approximately to the opening temperature of the thermostatic valve when the thermostatic working element is heated; that is, in the range of from 80° C. to 85° C.

The fan control circuit 18 contains a second comparison step 23 which compares the ACTUAL temperature ($T_{KW}$) of the coolant with a second desired value ($T_{KW\ Soll\ 2}$) and, if this value is exceeded, applies a signal to a non-negated input of a (N)AND-element 24. This (N)AND-element 24 is an AND-element with one negated input and one non-negated input. The output of the OR-element 14 is applied to the negated input of the (N)AND-element 24. At its output, the (N)AND-element 24 therefore will only emit a signal when no signal is present from the OR-element 14 which demands the switch-over of the thermostatic valve to the lower control level and the comparison step 23 simultaneously supplies a signal. The signal of the (N)AND-element 24 is also evaluated for switching on the fan 17. A second control step 25 is connected in front of the fan 17 in which fan outputs are filed which are assigned to coolant temperatures. An ACTUAL temperature signal ($T_{KW}$) of the coolant is supplied to the control step 25 so that this control step 25 will emit an output signal as a function of this temperature signal which specifies the output of the fan 17 particularly by way of the rotational speed. Between the control step 25 and the fan 17, a switch 26 is arranged which will be closed when the output of the (N)AND-element 24 emits a signal. Therefore, the fan 17 is switched on with an output corresponding to control step 25 only when the coolant temperature has exceeded the second desired value ($T_{KW\ Soll\ 2}$) and there is no simultaneous signal present for the switching-over of the thermostatic valve to the lower control level. Therefore, the fan 17 is operated by means of the control step 25 only when the thermostatic valve is set to the higher control level and therefore a raised coolant temperature is set. If therefore, for example, a raised coolant temperature of 115° C. is set, the desired value ($T_{KW\ Soll\ 2}$) of the comparison step 23 can, for example, be set at 110° C. In this case, the fan 17 participates by means of its cooling output only in the setting of the higher coolant temperature.

In a modified embodiment, it is provided that the fan 17 is not driven by an electric motor but by the internal-combustion engine itself, in which case a fluid clutch is arranged between the fan 17 and the internal-combustion engine which can be controlled by way of its filling.

In a simplified embodiment, the control steps 21 and/or 25 are omitted. In this case, the fan 17 is switched on directly by way of the signals of the AND-element 20 or of the (N)AND-element 24 and is then operated by a given program with respect to the rotational speed course or by a constant rotational speed.

In another embodiment, a common control step is provided whose signal, which determines the fan output, is switched through to the fan 17 either by the (N)AND-element 24 or the AND-element 20. Optionally, this may take place by means of an amplifier.

In another modified embodiment, the outputs of the (N)AND-element 24 and of the AND-element 20 are linked with one another by way of an OR-element. This OR-element is connected in front of a control step and, when an output signal is present on the OR-element, activates the control step which then emits an output signal to the fan 17 which is dependent on the ACTUAL temperature ($T_{KW}$). This embodiment also requires only one control step.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A cooling system for an internal-combustion engine of a motor vehicle comprising:

a thermostatic valve which controls the quantity of coolant which flows through at least one of a short-circuit pipe and a coolant radiator from an engine outlet to an engine inlet, and which thermostatic valve is switched by means of a signal depending on at least one of operating parameters of the internal-combustion engine and environmental parameters from a higher control level for the coolant temperature to a lower control level for the coolant temperature, and a fan which is assigned to the coolant radiator and which is switched by means of a fan control circuit, wherein the fan control circuit has a temperature comparison step which compares the actual temperature of the coolant with a first desired value and, when the first desired value is exceeded, generates a temperature signal which is applied to a first input of an AND-element, and the switching signal of the thermostatic valve being applied to a second input of the AND-element, which AND-element generates a switch-on signal for the fan.

2. A cooling system according to claim 1, wherein the first desired value for the temperature comparison step is in the range of the lower control level of the thermostatic valve.

3. A cooling system according to claim 2, wherein the first desired value corresponds approximately to an opening temperature of the thermostatic valve set to the lower control level.

4. A cooling system according to claim 1, wherein the fan control contains a control step determining the fan output as a function of the actual temperature of the coolant.

5. A cooling system according to claim 2, wherein the fan control contains a control step determining the fan output as a function of the actual temperature of the coolant.

6. A cooling system according to claim 3, wherein the fan control contains a control step determining the fan output as a function of the actual temperature of the coolant.

7. A cooling system according to claim 4, wherein the control step contains a characteristic diagram in which coolant temperatures and assigned fan outputs are filed.

8. A cooling system according to claim 1, wherein the fan control circuit contains an additional temperature comparison step which compares the actual temperature of the coolant with a second desired value and generates an additional temperature signal which represents an exceeding of the desired value and which is applied to a non-negated input of an additional AND-element, the switching signal for the thermostatic valve being applied to a negated input of the additional AND-element, which additional AND-element generates an additional switch-on signal for the fan.

9. A cooling system according to claim 2, wherein the fan control circuit contains an additional temperature comparison step which compares the actual temperature of the coolant with a second desired value and generates an additional temperature signal which represents an exceeding of the desired value and which is applied to a non-negated input of an additional AND-element, the switching signal for the thermostatic valve being applied to a negated input of the additional AND-element, which additional AND-element generates an additional switch-on signal for the fan.

10. A cooling system according to claim 3, wherein the fan control circuit contains an additional temperature comparison step which compares the actual temperature of the coolant with a second desired value and generates an additional temperature signal which represents an exceeding of the desired value and which is applied to a non-negated input of an additional AND-element, the switching signal for the thermostatic valve being applied to a negated input of the additional AND-element, which additional AND-element generates an additional switch-on signal for the fan.

11. A cooling system according to claim 4, wherein the fan control circuit contains an additional temperature comparison step which compares the actual temperature of the coolant with a second desired value and generates an additional temperature signal which represents an exceeding of the desired value and which is applied to a non-negated input of an additional AND-element, the switching signal for the thermostatic valve being applied to a negated input of the additional AND-element, which additional AND-element generates an additional switch-on signal for the fan.

12. A cooling system according to claim 7, wherein the fan control circuit contains an additional temperature comparison step which compares the actual temperature of the coolant with a second desired value and generates an additional temperature signal which represents an exceeding of the desired value and which is applied to a non-negated input of an additional AND-element, the switching signal for the thermostatic valve being applied to a negated input of the additional AND-element, which additional AND-element generates an additional switch-on signal for the fan.

13. A cooling system according to claim 8, wherein the second desired value is in the range of the higher control level of the thermostatic valve.

14. A cooling system according to claim 13, wherein the second desired value corresponds to the coolant temperature at which the thermostatic valve has opened approximately 75%.

15. A cooling system according to claim 8, wherein the fan control circuit contains an additional control step which can be activated by means of the switch-on signal of the additional temperature comparison step and which determines the fan output as a function of the actual temperature of the coolant.

16. A cooling system according to claim 13, wherein the fan control circuit contains an additional control step which can be activated by means of the switch-on signal of the additional temperature comparison step and which determines the fan output as a function of the actual temperature of the coolant.

17. A cooling system according to claim 14, wherein the fan control circuit contains an additional control step which can be activated by means of the switch-on signal of the additional temperature comparison step and which determines the fan output as a function of the actual temperature of the coolant.

18. A cooling system according to claim 15, wherein the additional control step contains a characteristic diagram in which coolant temperatures and assigned fan outputs are filed.

19. A method for controlling a cooling system for an internal-combustion engine of a motor vehicle having a thermostatic valve which controls the quantity of coolant which flows through at least one of a short-circuit pipe and a coolant radiator from an engine outlet to an engine inlet, which thermostatic valve is switched by means of a switching signal depending on at least one of operating parameters of the internal-combustion engine and environmental parameters from a higher control level for the coolant temperature to a lower control level for the coolant temperature, and having a fan which is assigned to the coolant radiator and which can be switched by means of a fan control circuit, said method comprising the steps of:

comparing the actual temperature of the coolant with a first desired value, generating a temperature signal when the actual temperature of the coolant exceeds the desired value, applying the temperature signal to a first input of an AND-element, applying the switching signal of the thermostatic valve to a second input of the AND-element, and generating a switch-on signal for the fan from the AND-element when said temperature signal and said switching signal are simultaneously applied to said first input and said second input, respectively.

20. A method according to claim 19, further comprising the steps of:

comparing the actual temperature of the coolant with a second desired value, generating an additional temperature signal when the actual temperature of the coolant exceeds the second desired value, applying the additional temperature signal to a non-negated input of an additional AND-element, applying the switching signal of the thermostatic valve to a negated input of the additional AND-element, and generating an additional switch-on signal for the fan from the additional AND-element when said additional temperature signal and no switching signal are simultaneously applied to said first input and said second input, respectively.

* * * * *